US005816365A

United States Patent [19]

Ruth

[11] Patent Number: 5,816,365

[45] Date of Patent: Oct. 6, 1998

[54] LADDER STABILIZING DEVICE

[76] Inventor: Troy L. Ruth, 537 Washington Ave., Bethlehem, Pa. 18017

[21] Appl. No.: 974,062

[22] Filed: Nov. 19, 1997

[51] Int. Cl.[6] ..... E06C 7/48

[52] U.S. Cl. ..... 182/206; 182/107

[58] Field of Search ..... 182/206, 107, 182/214

[56] References Cited

U.S. PATENT DOCUMENTS

| | | | |
|---|---|---|---|
| 2,473,951 | 6/1949 | Heckey . | |
| 2,840,291 | 6/1958 | Becker | 182/214 |
| 3,715,012 | 2/1973 | Perry | 182/214 |
| 4,194,592 | 3/1980 | Evans | 182/214 |

FOREIGN PATENT DOCUMENTS

| | | | |
|---|---|---|---|
| 268833 | 7/1965 | Australia | 182/206 |

*Primary Examiner*—Alvin C. Chin-Shue

[57] ABSTRACT

A new ladder stabilizing device for mounting to a rung of a ladder for helping keep a ladder resting against a pole stable. The inventive device includes a U-shaped stabilizing member that includes a pair of spaced apart elongate stabilizing arms. A proximal end of each stabilizing arm has a spaced apart upper and lower proximal end region which forms a rung slot between them that receives a rung of a ladder of the type which includes a pair of rails and a plurality of spaced apart rungs extending between the rails. The upper proximal end regions of the stabilizing arms are connected together by an upper lateral portion and the lower proximal end regions of the stabilizing arms are connected together by a lower lateral portion. Inner sides of the stabilizing arms face each other and define a post channel that receives an elongate post. An elongate mounting member that mounts to a rung of a ladder is positioned between proximal and distal ends of the stabilizing arms and extends across the post channel.

12 Claims, 2 Drawing Sheets

LADDER STABILIZING DEVICE

BACKGROUND OF THE INVENTION

1. Field of the Invention

The present invention relates to safety devices for ladders and more particularly pertains to a new ladder stabilizing device for mounting to a rung of a ladder for helping keep a ladder resting against a pole stable.

2. Description of the Prior Art

The use of safety devices for ladders is known in the prior art. More specifically, safety devices for ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art safety devices for ladders include U.S. Pat. No. 5,332,063; U.S. Pat. No. 4,946,004; U.S. Pat. No. 4,545,460; U.S. Pat. No. 4,469,194; U.S. Pat. No. 4,379,498; and U.S. Pat. No. 4,899,849.

While these devices fulfill their respective, particular objectives and requirements, the aforementioned patents do not disclose a new ladder stabilizing device. The inventive device includes a U-shaped stabilizing member that includes a pair of spaced apart elongate stabilizing arms. A proximal end of each stabilizing arm has a spaced apart upper and lower proximal end region which forms a rung slot between them that receives a rung of a ladder of the type which includes a pair of rails and a plurality of spaced apart rungs extending between the rails. The upper proximal end regions of the stabilizing arms are connected together by an upper lateral portion and the lower proximal end regions of the stabilizing arms are connected together by a lower lateral portion. Inner sides of the stabilizing arms face each other and define a post channel that receives an elongate post. An elongate mounting member that mounts to a rung of a ladder is positioned between proximal and distal ends of the stabilizing arms and extends across the post channel.

In these respects, the ladder stabilizing device according to the present invention substantially departs from the conventional concepts and designs of the prior art, and in so doing provides an apparatus primarily developed for the purpose of mounting to a rung of a ladder for helping keep a ladder resting against a pole stable.

SUMMARY OF THE INVENTION

In view of the foregoing disadvantages inherent in the known types of safety devices for ladders now present in the prior art, the present invention provides a new ladder stabilizing device construction wherein the same can be utilized for mounting to a rung of a ladder for helping keep a ladder resting against a pole stable.

The general purpose of the present invention, which will be described subsequently in greater detail, is to provide a new ladder stabilizing device apparatus and method which has many of the advantages of the safety devices for ladders mentioned heretofore and many novel features that result in a new ladder stabilizing device which is not anticipated, rendered obvious, suggested, or even implied by any of the prior art safety devices for ladders, either alone or in any combination thereof.

To attain this, the present invention generally comprises a U-shaped stabilizing member that includes a pair of spaced apart elongate stabilizing arms. A proximal end of each stabilizing arm has a spaced apart upper and lower proximal end region which forms a rung slot between them that receives a rung of a ladder of the type which includes a pair of rails and a plurality of spaced apart rungs extending between the rails. The upper proximal end regions of the stabilizing arms are connected together by an upper lateral portion and the lower proximal end regions of the stabilizing arms are connected together by a lower lateral portion. Inner sides of the stabilizing arms face each other and define a post channel that receives an elongate post. An elongate mounting member that mounts to a rung of a ladder is positioned between proximal and distal ends of the stabilizing arms and extends across the post channel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ladder stabilizing device apparatus and method which has many of the advantages of the safety devices for ladders mentioned heretofore and many novel features that result in a new ladder stabilizing device which is not anticipated, rendered obvious, suggested, or even implied by any of the prior art safety devices for ladders, either alone or in any combination thereof.

It is another object of the present invention to provide a new ladder stabilizing device which may be easily and efficiently manufactured and marketed.

It is a further object of the present invention to provide a new ladder stabilizing device which is of a durable and reliable construction.

An even further object of the present invention is to provide a new ladder stabilizing device which is susceptible of a low cost of manufacture with regard to both materials and labor, and which accordingly is then susceptible of low prices of sale to the consuming public, thereby making such ladder stabilizing device economically available to the buying public.

Still yet another object of the present invention is to provide a new ladder stabilizing device which provides in the apparatuses and methods of the prior art some of the advantages thereof, while simultaneously overcoming some of the disadvantages normally associated therewith.

Still another object of the present invention is to provide a new ladder stabilizing device for mounting to a rung of a ladder for helping keep a ladder resting against a pole stable.

Yet another object of the present invention is to provide a new ladder stabilizing device which includes a U-shaped stabilizing member that includes a pair of spaced apart elongate stabilizing arms. A proximal end of each stabilizing arm has a spaced apart upper and lower proximal end region which forms a rung slot between them that receives a rung of a ladder of the type which includes a pair of rails and a plurality of spaced apart rungs extending between the rails. The upper proximal end regions of the stabilizing arms are connected together by an upper lateral portion and the lower proximal end regions of the stabilizing arms are connected together by a lower lateral portion. Inner sides of the stabilizing arms face each other and define a post channel that receives an elongate post. An elongate mounting member that mounts to a rung of a ladder is positioned between proximal and distal ends of the stabilizing arms and extends across the post channel.

Still yet another object of the present invention is to provide a new ladder stabilizing device that holds a ladder secure to a post regardless of wind or swaying of the post.

Even still another object of the present invention is to provide a new ladder stabilizing device that prevents the need for two persons to safely use a ladder that is leaning on a post or pole.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
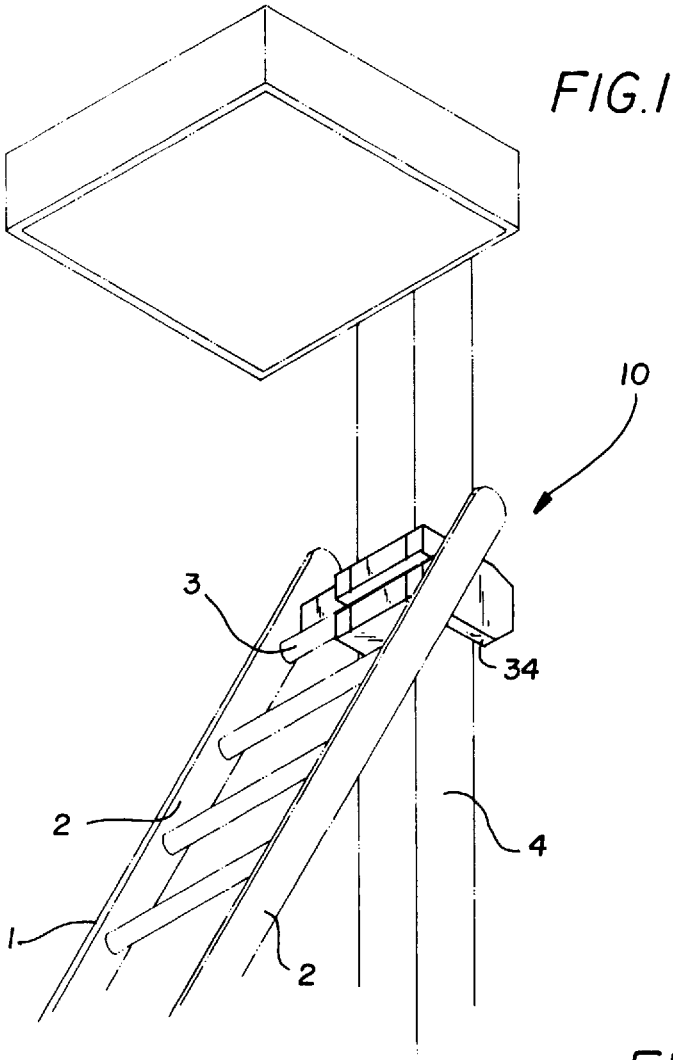
FIG. 1 is a perspective view of a new ladder stabilizing device in use according to the present invention.

With reference now to the drawings, and in particular to FIGS. 1 through 4 thereof, a new ladder stabilizing device embodying the principles and concepts of the present invention and generally designated by the reference numeral 10 will be described.

As best illustrated in FIGS. 1 through 4, the ladder stabilizing device 10 comprises a U-shaped stabilizing member 20 that includes a pair of spaced apart elongate stabilizing arms 30. A proximal end 31 of each stabilizing arm 30 has a spaced apart upper and lower proximal end region 37, 38 which forms a rung slot 39 between them that receives a rung 3 of a ladder 1 of the type which includes a pair of rails 2 and a plurality of spaced apart rungs 3 extending between the rails 2. The upper proximal end regions 37 of the stabilizing arms 30 are connected together by an upper lateral portion 40, while the lower proximal end regions 38 of the stabilizing arms 30 are connected together by a lower lateral portion 42. Inner sides 35 of the stabilizing arms 30 face each other and define a post channel 50 that receives an elongate post 4. An elongate mounting member 60 that mounts to a rung 3 of a ladder 1 is positioned between proximal and distal ends 31, 32 of the stabilizing arms 30 and extends across the post channel 50.

Figure 2:
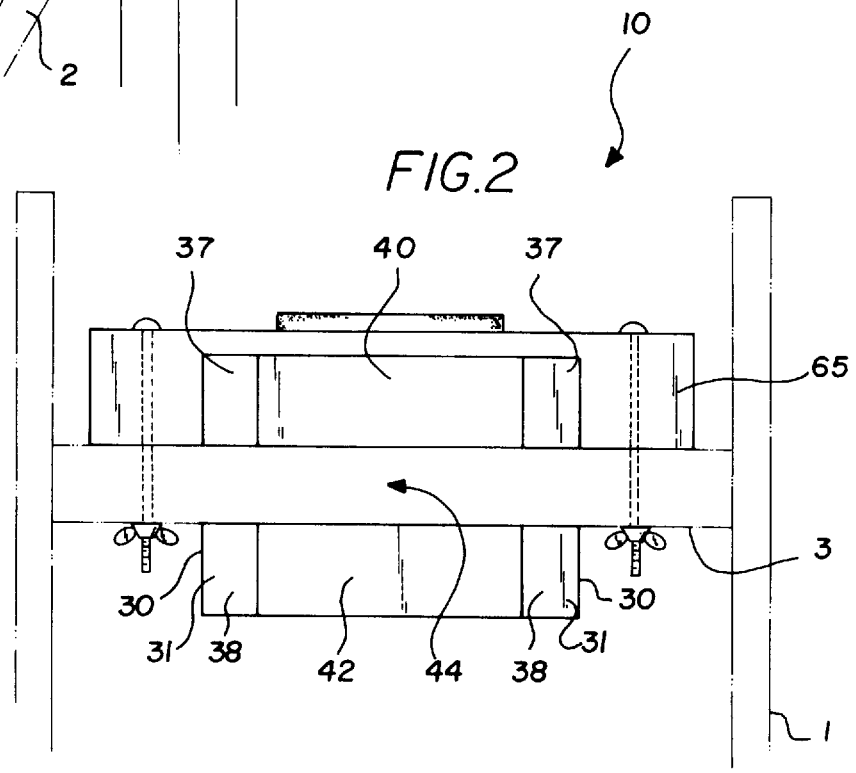
FIG. 2 is a side view of the present invention particularly illustrating the proximal end of the U-shaped stabilizing member.
Figure 3:
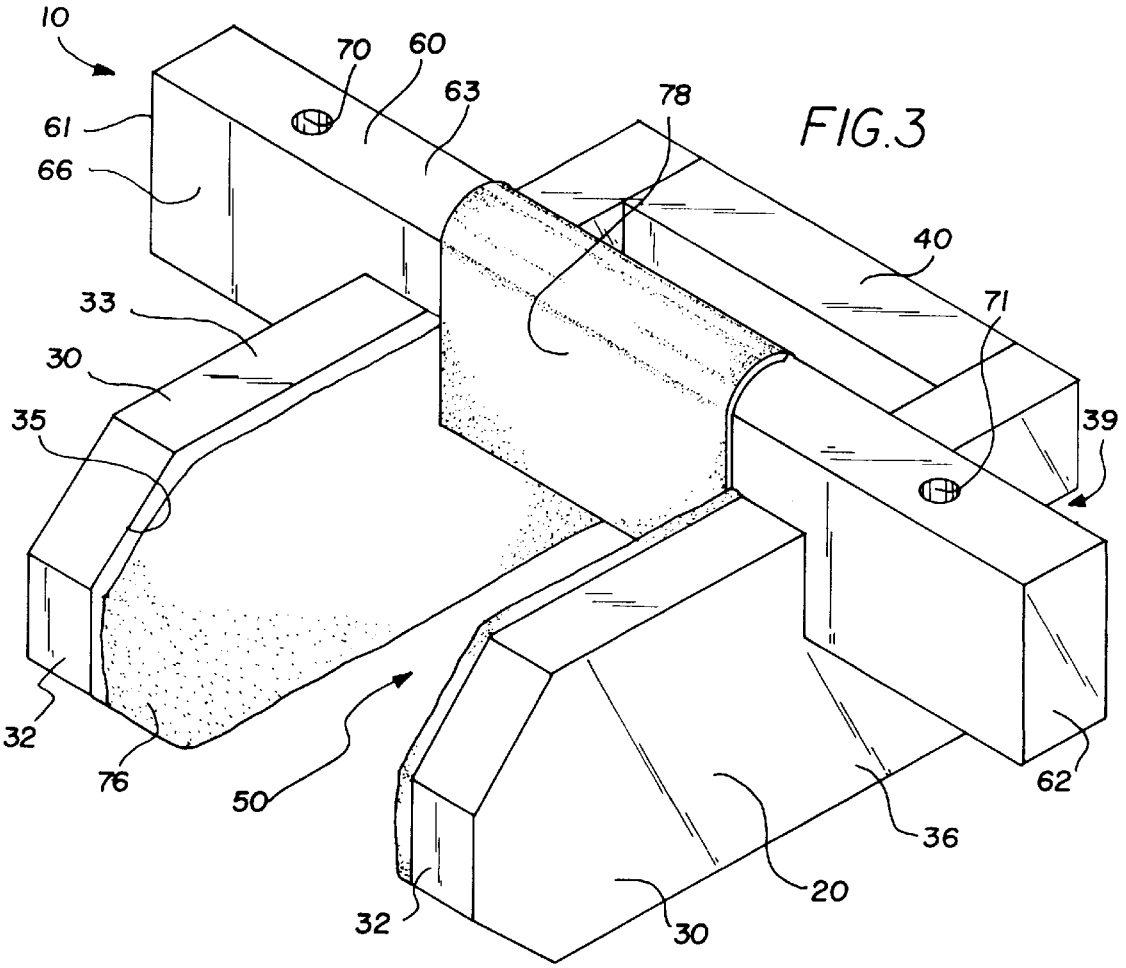
FIG. 3 is a perspective view of the present invention.
Figure 4:
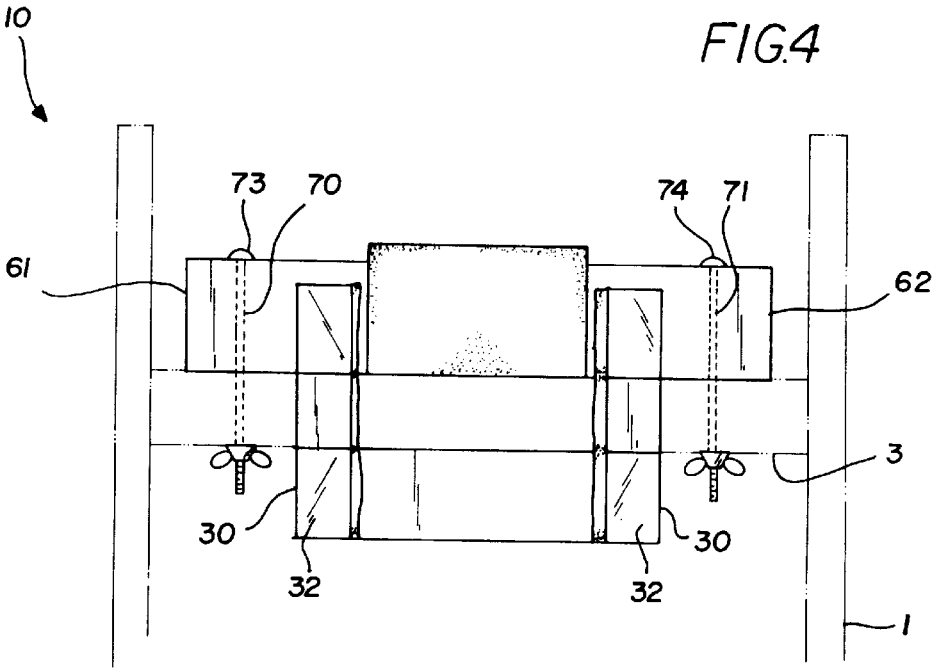
FIG. 4 is a side view of the present invention particularly illustrating the distal end of the U-shaped stabilizing member.

As illustrated in FIGS. 2, 3 and 4, the U-shaped stabilizing member 20 includes a pair of spaced apart elongate stabilizing arms 30 and spaced apart upper and lower lateral portions 40, 42. Each stabilizing arm 30 includes opposite proximal and distal ends 31, 32, upper and lower edges 33, 34, and inner and outer sides 35, 36.

Each proximal end 31 of the stabilizing arms 30 has a spaced apart upper and lower proximal end region 37, 38. A rung slot 39 which receives a rung 3 of a ladder 1 is formed in the space between the end regions 37, 38.

As shown in FIG. 2, the upper proximal end regions 37 of the stabilizing arms 30 are connected together by an upper lateral portion 40. The lower proximal end regions 38 of the stabilizing arms 30 are connected together by a lower lateral portion 42. The upper and lower lateral portions 40, 42 define a rung channel 44 which receives a rung 3 of a ladder 1.

As illustrated in FIGS. 1 and 3, the stabilizing arm inner sides 35 face each other to define a post channel 50 between them to receive an elongate post 4. Preferably, the distal ends 31 of the stabilizing arms 30 are tapered.

The elongate mounting member 60 includes opposite first and second ends 61, 62, top and bottom edges 63, 64, and proximal and distal surfaces 65, 66. The mounting member 60 extends across the post channel 50 and is positioned between the proximal and distal ends 31, 32 of the stabilizing arms 30. The mounting member 60 mounts to a rung 3 of the ladder 1 when the rung 3 of the ladder 1 is positioned adjacent the mounting member bottom edge 64. Preferably, the mounting member 60 is coupled to the stabilizing arms 30 of the stabilizing member 20 to add greater strength to the ladder stabilizing device 10.

The proximal surface 65 of the mounting member faces a lateral portion 40, 42 of the stabilizing member 20. The distal surface 66 of the mounting member 60 is positioned towards the distal ends 32 of the stabilizing arms 30.

Preferably, as shown in FIG. 3, the first end 61 of the mounting member 60 extends outwardly from one of the stabilizing arm outer sides 36. The second end 62 of the mounting member 60 extends outwardly from the other stabilizing arm outer side 36. The mounting member top edge 63 extends upwardly from the upper edges 33 of the stabilizing arms 30.

In the preferred embodiment, as depicted in FIGS. 2 and 4, a first bore 70 that receives a fastener 73 to attach the mounting member 60 to a rung 3 of a ladder 1 extends through the top and bottom edges 63, 64 of the mounting member 60. The first bore 70 is positioned between the mounting member first end 61 and one of the stabilizing member outer sides 36. Preferably, a first threaded fastener 37 extends through the first bore 70 to couple the mounting member 60 to a rung 3 of a ladder 1.

A second bore 71 that receives a fastener 74 to attach the mounting member 60 to a rung 3 of a ladder 1 extends through the top and bottom edges 63, 64 of the mounting member 60. The second bore 71 is positioned between the mounting member second end 62 and the other of the stabilizing member outer sides 36. Preferably, a second threaded fastener 74 extends through the second bore 71 to mount the mounting member 60 to a rung 3 of a ladder 1.

As shown in FIG. 3, also included in the preferred embodiment is a plurality of padding layers 76 which are provided on the surface of the inner side 35 of each stabilizing arm 30 to prevent scratching of the post 4 or pole. Ideally, the padding layers 76 comprise foamed rubber. A mounting member padded layer 78 is also provided on the distal surface 66 and the top edge 63 of the mounting member 60. The mounting member padded layer 78 extends between the inner sides 35 of the stabilizing arms 30. Ideally, the mounting member padded layer 78 comprises foamed rubber.

In an alternate embodiment, the ladder stabilizing device 10 further includes a ladder 1 that has a pair of rails 2 and a plurality of spaced apart rungs 3 that extend between the rails 2. The ladder 1 is coupled to the mounting member 60 by the first and second fasteners 73, 74 which extend through the first and second bores 70, 71.

In use, a ladder 1 of the type which includes a pair of rails 2 and a plurality of spaced apart rungs 3 extending between the rails 2 is provided. As shown in FIG. 2, the ladder stabilizing device 10 is positioned with respect to the ladder 1 is such a way that a rung 3 of the ladder 1 is positioned within the rung slot 39 and the rung channel 44 and adjacent the mounting member bottom edge 64. A first threaded fastener 73 is extended through the first bore 70 of the mounting member 60 and through a bore in the rung 3. Likewise, a second threaded fastener 74 is extended through the second bore 71 of the mounting member 60 and through a bore in the rung 3. As depicted in FIG. 1, the ladder 1 with the ladder stabilizing device 10 coupled to it is positioned with respect to a post 4 or pole such that the post 4 or pole is positioned within the post channel 50 adjacent the mounting member padded layer 78 on the mounting member distal surface 66. Ideally, the distance between the padding layers 76 on the stabilizing arm inner sides 35 is substantially the same as the width of the post 4 or pole such that the stabilizing member hugs the post 4 or pole. Also ideally, the ladder stabilizing device 10 is coupled to the top rung 3 of the ladder 1.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder stabilizing device for mounting to a rung of a ladder for helping keep a ladder resting against a pole stable, said ladder stabilizing device comprising:

a U-shaped stabilizing member having a pair of spaced apart elongate stabilizing arms and spaced apart upper and lower lateral portions, said stabilizing arms each having opposite proximal and distal ends, upper and lower edges, a notch being extended from said upper edge towards said lower edge, and inner and outer sides, said inner sides of said stabilizing arms being oriented substantially parallel to each other, said notches being positioned between said proximal and distal ends of said stabilizing arms;

each said proximal end of said stabilizing arms having spaced apart upper and lower proximal end regions to form a rung slot therebetween, said rung slots being for receiving a rung of a ladder therein;

said upper proximal end regions of said stabilizing arms being connected together by said upper lateral portion, said lower proximal end regions of said stabilizing arms being connected together by said lower lateral position;

said upper and lower lateral portions defining a rung channel therebetween, said rung channel being for receiving a rung of a ladder therein;

said stabilizing arms inner sides facing each other, said stabilizing arms inner sides defining a post channel therebetween for receiving an elongate post therein;

an elongate mounting member having opposite first and second ends, top and bottom edges, and proximal and distal surfaces, said mounting member being slidably inserted in said notches of said stabilizing arms and being extended across said post channel, said bottom edge of the mounting member being below said upper edges of said stabilizing arms to form a substantially continuous pole engaging surface with said inner sides of said stabilizing arms, said mounting member and said inner sides of said stabilizing arms forming a pole saddle for receiving a pole therein, said mounting member being for mounting to a rung of a ladder, said mounting member bottom edge being for positioning adjacent a rung of a ladder; and said proximal surface of said mounting member facing said lateral portion of said stabilizing member, said distal surface of said mounting member being positioned towards said distal ends of said stabilizing arms.

2. The ladder stabilizing device of claim 1, wherein said distal ends of said stabilizing arms are tapered for sliding around a pole.

3. The ladder stabilizing device of claim 1, wherein the length of said mounting member between the inside surfaces of said stabilizing arms is substantially equal to the length of each of the stabilizing arms between the mounting member and the distal ends of the stabilizing arms to create a substantially square saddle for receiving a pole portion therein.

4. The ladder stabilizing device of claim 1, wherein said mounting member top edge is upwardly extended from said upper edges of said stabilizing arms.

5. The ladder stabilizing device of claim 1, wherein a first bore is extended through said top and bottom edges of said mounting member, said first bore being for extending a fastener therethrough for mounting said mounting member to a rung of a ladder.

6. The ladder stabilizing device of claim 1, wherein said first end of said mounting member is outwardly extended from one of said stabilizing arm outer sides, said second end of said mounting member is outwardly extended from the other of said stabilizing arm outer sides.

7. The ladder stabilizing device of claim 6, wherein a first bore is extended through said top and bottom edges of said mounting member, said first bore being positioned between said mounting member first end and said one of said stabilizing member outer sides, said first bore being for extending a fastener therethrough for mounting said mounting member to a rung of a ladder and a first threaded fastener being extended through said first bore, said first threaded fastener being adapted for attaching said mounting member to a rung of a ladder by extending through said rung of said ladder.

8. The ladder stabilizing device of claim 7, wherein a second bore is extended through said top and bottom edges of said mounting member, said second bore being positioned between said mounting member second end and said other of said stabilizing member outer sides, said second bore being for extending a fastener therethrough for mounting said mounting member to a rung of a ladder and a second threaded fastener being extended through said second bore, said second threaded fastener being adapted for attaching said mounting member to a rung of a ladder by extending through said rung of said ladder.

9. The ladder stabilizing device of claim 8, further comprising a ladder having a pair of rails and a plurality of spaced apart rungs extending between said rails, and wherein said first threaded fastener passes through said mounting member and one said rung of said ladder.

10. The ladder stabilizing device of claim 1, further comprising a plurality of padding layers, a said padding layer being provided on each said inner surface of said stabilizing arms, a mounting member padded layer being provided on said distal surface and said top edge of said mounting member, said mounting member padded layer being extended between said inner sides of said stabilizing arms.

11. The ladder stabilizing device of claim 10, wherein said padding layers comprise foamed rubber.

12. A ladder stabilizing device for mounting to a rung of a ladder for helping keep a ladder resting against a pole stable, said ladder stabilizing device comprising:

a U-shaped stabilizing member having a pair of spaced apart elongate stabilizing arms and spaced apart upper and lower lateral portions, said stabilizing arms each having opposite proximal and distal ends, upper and lower edges, a notch being extended from said upper edge towards said lower edge, and inner and outer sides, said inner sides of said stabilizing arms being oriented substantially parallel to each other, said notches being positioned between said proximal and distal ends of said stabilizing arms;

each said proximal end of said stabilizing arms having spaced apart upper and lower proximal end regions to form a rung slot therebetween, said rung slots being for receiving a rung of a ladder therein;

said upper proximal end regions of said stabilizing arms being connected together by said upper lateral portion, said lower proximal end regions of said stabilizing arms being connected together by said lower lateral portion;

said upper and lower lateral portions defining a rung channel therebetween, said rung channel being for receiving a rung of a ladder therein;

said stabilizing arms inner sides facing each other, said stabilizing arms inner sides defining a post channel therebetween for receiving an elongate post therein;

said proximal ends of said stabilizing arms being tapered;

an elongate mounting member having opposite first and second ends, top and bottom edges, and proximal and distal surfaces, said mounting member being slidably inserted in said notches of said stabilizing arms and being extended across said post channel, said bottom edge of the mounting member being below said upper edges of said stabilizing arms to form a substantially continuous pole engaging surface with the inner sides of the stabilizing arms, said mounting member and said inner sides of said stabilizing arms forming a pole saddle for receiving a pole therein, said mounting member being for mounting to a rung of a ladder, said mounting member bottom edge being for positioning adjacent a rung of a ladder;

said first end of said mounting member being outwardly extended from one of said stabilizing arm outer sides, said second end of said mounting member being outwardly extended from the other of said stabilizing arm outer sides, said mounting member top edge being upwardly extended from said upper edges of said stabilizing arms;

said proximal surface of said mounting member facing said lateral portion of said stabilizing member, said distal surface of said mounting member being positioned towards said distal ends of said stabilizing arms;

wherein the length of said mounting member between the inside surfaces of said stabilizing arms is substantially equal to the length of each of the stabilizing arms between the mounting member and the distal ends of the stabilizing arms to create a substantially square saddle for receiving a pole portion therein;

a first bore being extended through said top and bottom edges of said mounting member, said first bore being positioned between said mounting member first end and said one of said stabilizing member outer sides, said first bore being for extending a fastener therethrough for mounting said mounting member to a rung of a ladder;

a second bore being extended through said top and bottom edges of said mounting member, said second bore being positioned between said mounting member second end and said other of said stabilizing member outer sides, said second bore being for extending a fastener therethrough for mounting said mounting member to a rung of a ladder;

a first threaded fastener being extended through said first bore, said first threaded fastener being adapted for attaching said mounting member to a rung of a ladder by extending through said rung of said ladder;

a second threaded fastener being extended through said second bore, said second threaded fastener being adapted for attaching said mounting member to a rung of a ladder by extending through said rung of said ladder;

a plurality of padding layers, a said padding layer being provided on each said inner side of said stabilizing arms, wherein said padding layers comprise foamed rubber; and a mounting member padded layer being provided on said distal surface and said top edge of said mounting member, said mounting member padded layer being extended between said inner sides of said stabilizing arms, wherein said mounting member padded layer comprises foamed rubber.

* * * * *